United States Patent [19]

Waki et al.

[11] Patent Number: 4,496,248

[45] Date of Patent: Jan. 29, 1985

[54] STRUCTURE FOR A WATCH CASE MADE OF CEMENTED CARBIDE

[75] Inventors: Masahiko Waki; Seiji Umezawa; Tsuneji Takasugi; Hiroshi Koide; Takao Kasai, all of Tokyo, Japan

[73] Assignee: Citizen Watch Company Limited, Tokyo, Japan

[21] Appl. No.: 342,749

[22] Filed: Jan. 26, 1982

[30] Foreign Application Priority Data

Feb. 20, 1981 [JP] Japan ..... 56-23200
Jul. 16, 1981 [JP] Japan ..... 56-106475

[51] Int. Cl.[3] ..... G04B 37/00
[52] U.S. Cl. ..... 368/280; 368/291; 368/294
[58] Field of Search ..... 368/276–298

[56] References Cited

U.S. PATENT DOCUMENTS 4,035,673 7/1977 Ishida et al. ..... 310/344
4,363,555 12/1982 Finger ..... 368/291

*Primary Examiner*—Bernard Roskoski
*Attorney, Agent, or Firm*—Koda and Androlia

[57] ABSTRACT

A structure of a watch case, which comprises a watchglass, a case band member composed of a cemented carbide alloy and having a flange formed at an upper portion thereof and an annular surface formed at a lower portion of the flange, a watchglass supporting ring brazed to the case band member and having an upper surface for supporting a bottom surface of the watchglass, a packing for providing a waterproof and a back cover secured to the case band member. The packing is provided between the outer periphery of the watchglass and an annular groove. The annular groove is formed by the flange and annular surface of the case band member and the upper surface of the watchglass supporting ring.

3 Claims, 4 Drawing Figures

STRUCTURE FOR A WATCH CASE MADE OF CEMENTED CARBIDE

BACKGROUND OF THE INVENTION

1. Field of the Invention

The present invention relates to a watch case, and more particularly to a structure of a watch case using a cemented carbide alloy.

2. Prior Art

The watch cases using cemented carbide alloy have an attractive ground surface and a high hardness. Those watch cases are hard enough to retain their original attractive appearance without scratches. Such watch cases have come into widespread use in recent years. However, the cemented carbide alloy is hard and brittle and, when it is machined, the machining methods which can be used are limited to machining, grinding, polishing and the like. The cemented carbide alloy therefore, can be applied only to the very simple-shape cases.

When a bezel is made using the cemented carbide alloy, it is not possible to form a structure in which the bezel is fixed by a packing, or a structure in which the upper portion of the packing is concealed by a flange composed of the cemented carbide alloy. If a C-shaped packing accommodating groove is formed in an unitary case band composed of the cemented carbide alloy, grinding or discharge machining must be employed. Such machining operations present major difficulties in view of cost, machining precision and design restrictions.

Further, conventional watch cases which employ cemented carbide alloy have considerable thickness because of the difficulty of machining the cemented carbide alloy. Accordingly, it is difficult to produce a thin, compact and attractive watch case.

The present invention seeks to overcome the above-mentioned problems encountered in the prior art.

SUMMARY OF THE INVENTION

It is, therefore, an object of the present invention to provide a watch case structure having increased strength of the watch case against physical impact.

It is another object of the present invention to provide a watch case structure offering a much wider variety of design variations.

It is another object of the present invention to provide a watch case structure adapted to fixedly retain a watchglass onto a bezel or case band of a timepiece.

In keeping with the principles of the present invention, the above-mentioned objects are accomplished by an unique structure of a watch case, which comprises a watchglass, a case band member containing cemented carbide alloy and having a flange formed at an upper portion of the case band member and an annular surface formed at a lower portion of the flange, a watchglass seating ring brazed to the case band and having an upper surface for seating a bottom surface of the watchglass, a packing for providing a waterproof and a back cover secured to the case band member. By this structure, the packing is sandwiched between the watchglass and an annular groove formed by the flange and annular surface of the case band member and the upper surface of the watchglass seating ring.

BRIEF DESCRIPTION OF THE DRAWINGS

These and other objects, features and advantages of the present invention will become more apparent from the following description when taken in conjunction with the accompanying drawings, in which.

DETAILED DESCRIPTION OF THE INVENTION

Figure 1:
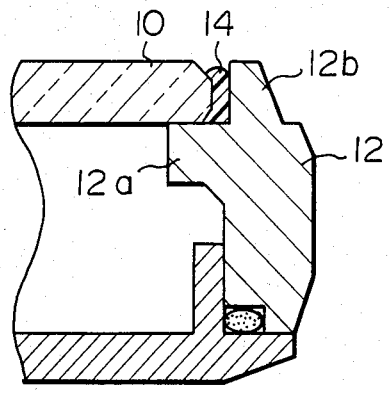
Fig. 1 PRIOR ART
FIG. 1 is a cross-sectional view illustrating a structure of a conventional watch case which employs a cemented carbide alloy.

FIG. 1 is a cross-sectional view showing a structure of a prior art watch case which employs the cemented carbide alloy.

In FIG. 1, a watchglass 10 is pressed-fitted into the stepped portion of a case band 12 through the intermediary of a packing 14. The case band 12 is composed of a cemented carbide alloy, and the stepped portion of the case band 12 includes a ring-shaped watchglass seating portion 12*a* and a ring-shaped vertical portion 12*b*. When the watchglass 10 is pressed into the stepped portion of the case band 12, strong vertically directed force and diametrically directed force act upon the case band 12. These forces cause the seating portion 12*a* and/or the vertical portion 12*b* to break. Further, when the wristwatch is dropped from one's wrist, the case band 12 is broken by an impact resulting from dropping the wristwatch.

Accordingly, it is necessary to provide the case band having a sufficient thickness for preventing the breakage of the case band.

Figure 2:
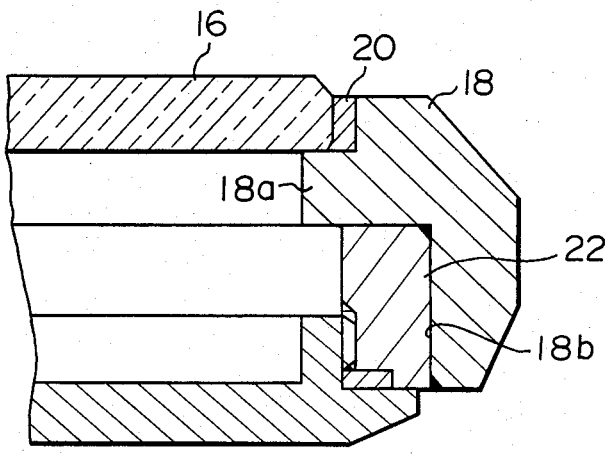
Fig. 2 PRIOR ART
FIG. 2 is a cross-sectional view illustrating a structure of another conventional watch case which employs a cemented carbide alloy.

FIG. 2 is a cross-sectional view showing a structure of another conventional watch case which employs the cemented carbide alloy.

A watchglass 16 is press-fitted into the stepped portion of a case band 18 through the intermediary of a packing 20. The case band 18 is composed of a cemented carbide alloy. In FIG. 2, the watch case includes an inner case band 22. The inner case band 22 is brazed to an annular step 18*b* and interposed between a lower surface of a ring-shaped watchglass seating portion 18*a* and an inner surface of a back cover 24 to provide a reinfforcement of the case band 18. When the watchglass 16 is pressed into the step portion of the case band 18, vertically directed force acting upon the watchglass seating portion 18*a* is propagated through the inner case band 22 to a jig (not shown), and the breakage of the case band 18 is preventable.

In brazing the inner case band 22 to the case band 18 being composed of the cemented carbide alloy, if the coefficient of thermal expansion of the material of the inner case band 22 is much different from the coefficient of thermal expansion of the cemented carbide alloy, the inner case band 22 contracts to a greater extent than the case band 18 upon cooling process. Consequently, the brazing material peels and the case band 18 cracks.

It is necessary, therefore, that the materials of the inner case band 22 and the case band 18 have approximately equivalent coefficients of thermal expansion. It is preferred also that the materials have good workability. A sintered alloy having a metallic carbide as main constituent, which alloy is referred to as a cemented carbide, generally has a coefficient of thermal expansion of from $4.5\times10^{-6}$/°C. to $13.5\times10^{-6}$/°C. The coefficient of thermal expansion of the inner case band 22 must therefore, be chosen close to the above range of values. In FIG. 2, the inner case band 22 is partially exposed outside of the watch case. It is therefore, required that the inner case band 22 be highly non-corrosive. For this reason, titanium (Ti), zirconium (Zr), tungsten (W), molybdenum (Mo) and alloys thereof are employed as the main constituents of the material of the inner case band 22. The coefficient of thermal expansion for metals of this type is from $5.5\times10^{-6}$/°C. to $12.8\times10^{-6}$/°C., satisfying the above condition. In general, however, material costs of the metals are high, and costs become higgher since the materials are difficult to shape. It is therefore, not easy to make use of such materials.

Figure 3:
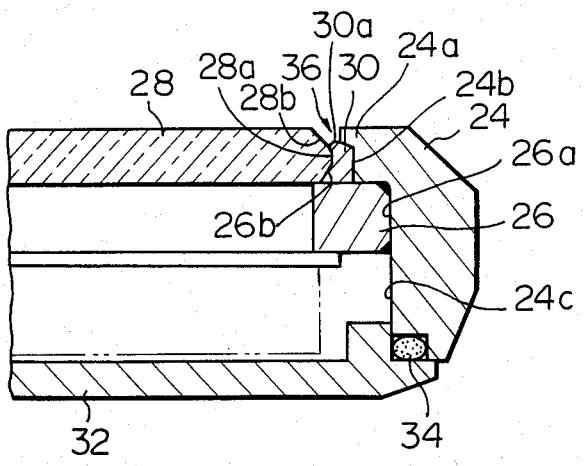
FIG. 3 is a cross-sectional view illustrating a first embodiment of a watch case structure according to the present invention.

FIG. 3 is a cross-sectional view illustrating a first embodiment of a watch case structure according to the present invention. A reference numeral 24 denotes a case band composed of a cemented carbide alloy comprising a metallic oxide, metallic carbide, metallic nitride, metallic boride or metallic silicide, 26 a decorative ring which serves as a watchglass supporting ring, 28 a watchglass, 30 a packing, 32 a back cover and 34 an O-ring.

The inner circumferential surface of the case band 24 is formed to include an inwardly projecting ring-shaped flange 24*a* for compressing the upper edge of the packing 30, an inwardly facing annular surface 24*b* for securing the packing 30, and an annular step 24*c*. The watchglass supporting ring 26 includes an outer diametrical surface 26*a* brazed to the step 24*c* of the case band 24, and an upper surface 26*b* for seating the bottom surface of the packing 30 and the watchglass 28. An inwardly facing annular groove 36 for accommodating the packing 30 is formed by the combination of the flange 24*a*, the annular surface 24*b* of the case band 24 and the upper surface 26*b* of the watchglass supporting ring 26. The watchglass 28 includes an outer peripheral surface 28*a* formed with a vertical portion and an upper inclined surface 28*a* formed at a portion above the outer peripheral surface 28*a*. The packing 30 is compressed between the outer peripheral surface 28*a* of the watchglass 28 and the annular groove 36, whereby a protrusion 30*a* is formed between the flange 24*a* of the case band 24 and the upper inclined surface 28*b* of the watchglass 28 and engages the upper inclined surface 28*b* of the watchglass 28 to press the watchglass. The back cover 32 is screwed into the case band 24, compressing the O-ring 34, therefore, the watchglass supporting ring 26 is closed into the watch case.

When the watchglass 28 is pressed into the case band 24, the watchglass supporting ring 26 directly receives the vertically directed force to prevent the breakage of the case band 24 and also the case band 24 being reinforced by the watchglass supporting ring 26 is bearable to be broken by the diametrically directed force.

In this embodiment, the ring 26 is closed into the watch case, therefore, it is not necesary that the ring 26 is highly non-corrosive. Thus, in this embodiment, an alloy consisting of iron (Fe), nickel (Ni) and cobalt (Co) (named Fe-Ni-Co alloy) or an alloy consisting of iron (Fe) and nickel (Ni) (named Fe-Ni alloy) is selected as the material of the watchglass supporting ring, such as alloy having good workability and the coefficient of thermal expansion being approximately equivalent to the coefficient of thermal expansion of the cemented carbide alloy and enabling a reduction in cost. Especially, Fe-Ni-Co alloy has excellent extensibility and is readily worked into complicated shapes. In addition, Fe-Ni-Co alloy has a high melting point and an excellent brazing property. These alloys generally are not sufficiently non-corrosive and cannot be employed when exposed from the outside of the watch case as in the prior art. However, when the alloys are employed as a watchglass supporting ring within a watch case having a reliable waterproof structure achieved in accordance with the present invention, the watchglass supporting ring can be composed of Fe-Ni-Co or Fe-Ni alloy. In particular, Fe-Ni-Co alloy has a high impact-absorbing property so that brazing the Fe-Ni-Co alloy to the inner side of the cemented carbide case greatly enhances the impact resistance of the case.

Figure 4:
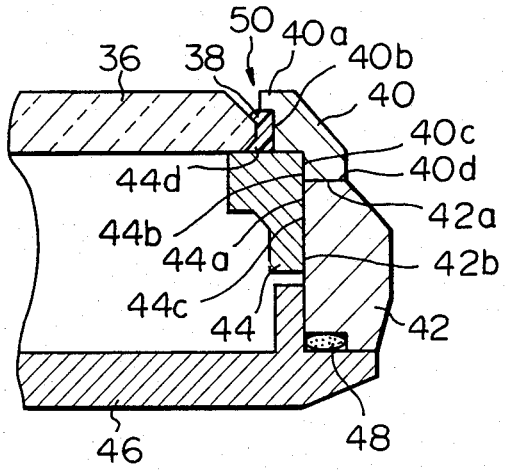
FIG. 4 is a cross-sectional view illustrating a second embodiment of a watch case structure according to the present invention.

FIG. 4 shows a second embodiment of a watch case structure according to the present invention. A reference numeral 36 denotes a watchglass, 38 a packing, 40 a bezel composed of the cemented carbide alloy comprising a metallic oxide, metallic carbide, metallic nitride, metallic boride or metallic silicide, 42 a case band composed of the cemented carbide alloy, 44 an inner case band which serves as a watchglass supporting ring, 46 a back cover and 48 an O-ring.

The bezel 40 comprises an inwardly projecting ring-shaped flange 40*a* provided on the inner periphery of the top part of the bezel 40 for compressing the upper edge of the packing 38. The bezel is further provided with an inwardly facing annular surface 40*b* for securing the packing 38, and an inwardly facing annular step 40*c* having a diameter larger than the annular surface 40*b*. The watchglass supporting ring 44 is water-tightly secured to the bezel 40 by means of a brazing material provided between the upper portion 44*b* of the outer surface 44*a* of the watchglass supporting ring 44 and the annular step 40*c* of the bezel 40. Further, the watchglass supporting ring 44 is water-tightly secured to the case band 42 by means of a brazing material provided between the lower portion 44*c* of the outer surface 44*a* of the watchglass supporting ring 44 and the inwardly facing annular wall 42*b* of the case band 42. The watchglass supporting ring 44 has an upper surface 44*d* for supporting the bottom surface of the packing 38 and the watchglass 36 and also is closed into the watch case. The watchglass 36 is fixed in an inwardly facing annular groove 50 formed by the upper surface 44*d* of the watchglass supporting ring 44. The flange 40*a* and the annular surface 40*b* of the bezel 40 are united by diametrically compressing the packing 38 which is disposed in the groove 50. The bezel 40 is water-tightly secured to the case band 42 by means of a brazing material provided between the lower surface 40*d* of the bezel 40 and the upper surface 42*a* of the case band 42. It should be noted that the lower surface 40*d* of the bezel 40 and the surface 42*a* of the case band 42 can be in simple contact, with no brazing material being applied.

In addition, the watchglass supporting ring 44 is composed of a material other than a cemented carbide, such as stanless steel, brass, aluminum, a vibration absorbing steel, Fe-Ni alloy or Fe-Ni-Co alloy.

In accordance with the embodiment shown in FIG. 4, penetration of water into the interior of the watch case is prevented by the packing between the watchglass and bezel and by the brazing material between the watchglass supporting ring and bezel and between the watchglass supporting ring and the case band.

Since the watch case is divided into three units including the case band, bezel and watchglass supporting ring and since the watchglass supporting ring is composed of a material other than a cemented carbide, externally applied impact is absorbed by the watchglass supporting ring. The impact resistance of the entire watch case therefore, can be enhanced.

In the present invention, the securing force directed toward the upper portion of the packing is intensified by forming the inwardly facing annular groove. In addition, by making the upper inclined surface on the outer circumference of the watchglass lower in height than the packing, a portion of the packing covers the upper inclined surace of the watchglass after the watchglass is installed. Thus, the force for securing the watchglass and the water-tightness of the watchglass are improved and also the diametric force applied to the bezel or case band is reduced, so that the case band or bezel can withstand impact. Further, the inwardly facing annular groove is formed by two parts, it is not necessary to adopt the very difficult conventional practice of machining a groove in a cemented carbide.

In accordance with the present invention, it is possible to manufacture a cemented carbide watch case at low cost and having an attractive external appearance and a highly reliable waterproof property.

We claim:

1. A structure for a watch case made of cemented carbide, comprising:

a watchglass having an outer peripheral surface formed with a vertical portion and an upper inclined surface formed at a portion above said outer peripheral surface;

a case band composed of a cemented carbide alloy, said case band having an inwardly projecting ring-shaped flange formed at an upper portion thereof, an inwardly facing annular step formed at a lower portion of said inwardly facing annular surface;

a watch glass supporting ring composed on an alloy consisting of iron and nickel, said watchglass supporting ring having an outer diametrical surface brazed to said annular step of said case band and an upper surface for supporting a bottom surface of said watchglass;

a packing for providing a waterproof seal; and a back cover secured to said case band;

wherein said packing is provided and compressed between said outer peripheral surface of said watchglass and an annular groove formed by said flange and annular surface of said case band and said upper surface of said watchglass supporting ring, and includes a protrusion protruding into the space between said flange of said case band and said upper inclined surface of said watchglass, said protrusion engaging said upper inclined surface of said watchglass to retain said watchglass in a fixed place.

2. A structure for a watch case made of cemented carbide, comprising:

a watchglass having an outer peripheral surface formed with a vertical portion and an upper inclined surface formed at a portion above said outer peripheral surface;

a case band composed of a cemented carbide alloy, said case band having an inwardly projecting ring-shaped flange formed at an upper portion thereof, an inwardly facing annular surface formed at a lower portion of said flange and an annular step formed at a lower portion of said inwardly facing annular surface;

a watch glass supporting ring composed of an alloy consisting of iron, nickel and cobalt, said watchglass supporting ring having an outer diametrical surface brazed to said annular step of said case band and an upper surface for supporting a bottom surface of said watchglass;

a packing for providing a waterproof seal; and a back cover secured to said case band;

wherein said packing is provided and compressed between said outer peripheral surface of said watchglass and an annular groove formed by said flange and annular surface of said case band and said upper surface of said watchglass supporting ring, and includes a protrusion protruding into the space between said flange of said case band and said upper inclined surface of said watchglass, said protrusion engaging said upper inclined surface of said watchglass to retain said watchglass in a fixed place.

3. A structure for a watch case made of cemented carbide, comprising:

a watchglass having an outer peripheral surface formed with a vertical portion and an upper inclined surface formed at a portion above said outer peripheral surface;

a case band composed of a cemented carbide alloy, said case band having an inwardly projecting ring-shaped flange formed at an upper portion thereof, an inwardly facing annular surface formed at a lower portion of said flange and an annular step formed at a lower portion of said inwardly facing annular surface;

a watchglass supporting ring composed of a material selected from a group of a stainless steel, brass, aluminum and vibration absorbing steel, said watchglass supporting ring having an outer diametrical surface brazed to said annular step of said case band and an upper surface for supporting a bottom surface of said watchglass;

a packing for providing a waterproof seal; and a back cover secured to said case band;

wherein said packing is provided and compressed between said outer peripheral surface of said watchglass and an annular groove formed by said flange and annular surface of said case band and said upper surface of said watchglass supporting ring, and includes a protrusion protruding into the space between said flange of said case band and said upper inclined surface of said watchglass, said protrusion engaging said upper inclined surface of said watchglass to retain said watchglass in a fixed place.

* * * * *